US008616239B2

(12) United States Patent
Bell

(10) Patent No.: US 8,616,239 B2
(45) Date of Patent: Dec. 31, 2013

(54) INCREASING FLUIDITY OF A FLOWING FLUID

(71) Applicant: Douglas Bell, Oley, PA (US)

(72) Inventor: Douglas Bell, Oley, PA (US)

(73) Assignee: Save The World Air, Inc., Santa Barbara, CA (US)

( * ) Notice: Subject to any disclaimer, the term of this patent is extended or adjusted under 35 U.S.C. 154(b) by 0 days.

(21) Appl. No.: 13/762,017

(22) Filed: Feb. 7, 2013

(65) Prior Publication Data

US 2013/0146149 A1 Jun. 13, 2013

Related U.S. Application Data

(63) Continuation of application No. 12/404,233, filed on Mar. 13, 2009, now abandoned.

(51) Int. Cl.
*F15C 1/04* (2006.01)

(52) U.S. Cl.
USPC ..... 137/827; 137/803; 137/13; 204/554; 204/660; 204/164

(58) Field of Classification Search
USPC ..... 137/803, 827, 13; 204/554, 563, 565, 204/660, 672, 673, 674, 164
See application file for complete search history.

(56) References Cited

U.S. PATENT DOCUMENTS 3,349,354 A 10/1967 Miyata
3,880,192 A 4/1975 Denizov et al.
4,203,398 A 5/1980 Maruoka
4,254,800 A 3/1981 Masaki
4,519,919 A 5/1985 Whyte et al.
4,611,615 A 9/1986 Petrovic
5,074,324 A * 12/1991 Ng ..... 137/13
5,185,086 A 2/1993 Kaali et al.
5,333,646 A 8/1994 Delot
5,411,143 A 5/1995 Greene
5,480,522 A 1/1996 Ibbott
5,664,546 A 9/1997 De La Torre Barreiro
5,673,721 A 10/1997 Alcocer
5,702,600 A 12/1997 Pandolfo
5,918,636 A 7/1999 Mitchell et al.
5,958,213 A 9/1999 Goto
6,093,287 A 7/2000 Sanderson
6,334,957 B1 1/2002 Waskaas (Continued)

FOREIGN PATENT DOCUMENTS

WO 2008054753 5/2008

OTHER PUBLICATIONS

Tao, R. and Xu, X., Reducing the Viscosity of Crude Oil by Pulsed Electric of Magnetic Field, Journal, Published Jul. 14, 2006, 6 pages.

(Continued)

*Primary Examiner* — Eric Keasel
*Assistant Examiner* — Minh Le
(74) *Attorney, Agent, or Firm* — Jones Walker LLP

(57) ABSTRACT

There is disclosed apparatus and processes for increasing fluidity of a flowing fluid. The apparatus may have a number of treatment chambers adapted to receive and pass the flowing fluid. In each treatment chamber a field is applied to the fluid. The fields may be parallel to the fluid's direction of flow, and may alternate in sequence. The fluidity of the fluid is increased through exposure to the fields.

23 Claims, 8 Drawing Sheets

(56) References Cited

U.S. PATENT DOCUMENTS

| | | | | |
|---|---|---|---|---|
| 6,599,419 | B2 | 7/2003 | Hagans | |
| 6,746,613 | B2 * | 6/2004 | Korenev | 204/554 |
| 6,827,822 | B2 | 12/2004 | Tao et al. | |
| 6,852,235 | B2 * | 2/2005 | Holland | 210/695 |
| 6,875,360 | B2 | 4/2005 | Allen et al. | |
| 7,704,364 | B2 | 4/2010 | Merrill et al. | |
| 7,981,288 | B2 | 7/2011 | Bradley et al. | |
| 8,043,511 | B2 * | 10/2011 | Holland | 210/695 |
| 2008/0190771 | A1 | 8/2008 | Tao et al. | |
| 2008/0257414 | A1 | 10/2008 | Tao et al. | |
| 2010/0140096 | A1 | 6/2010 | Yang et al. | |
| 2011/0168273 | A1 | 7/2011 | Morgenstern | |
| 2011/0240474 | A1 | 10/2011 | Seed et al. | |

OTHER PUBLICATIONS

Tao, R., The Physical Mechanism to Reduce Viscosity of Liquid Suspensions, International Journal of Modern Physics B, vol. 21, Nos. 28 & 29 (2007) 4767-4773, 7 pages.

Tao, R., Electric-Field Assisted Fuel Atomization, Department of Physics, Temple University, Philadelphia, PA 19122, USA, 5 pages.

Tao, R., Huang, K., Tang, H., Bell, D., Electrorheology Leads to Efficient Combustion, Energy & Fuels 2008, 22, 3785-3788, Published Sep. 12, 2008, 4 pages.

* cited by examiner

INCREASING FLUIDITY OF A FLOWING FLUID

CROSS-REFERENCE TO RELATED APPLICATION

This application is a continuation of application Ser. No. 12/404,233, filed on Mar. 13, 2009.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to increasing fluidity of a flowing fluid.

2. Description of the Related Art

Fluidity is a measure of the resistance of a fluid which is being deformed by either shear stress or extensional stress. In everyday terms (and for liquids only), fluidity is "pourability". Thus, water is usually considered "thin", having a higher fluidity, whereas pitch is "thick" having a fluidity about 100 billion times lower than water. Fluidity describes a fluid's internal resistance to flow and may be thought of as a measure of fluid friction. For example, low-fluidity lava will create a tall, steep stratovolcano, because it cannot flow far before it cools, while high-fluidity lava will create a wide, shallow-sloped shield volcano. All real fluids (except superfluids) have some resistance to stress.

Fluidity in gases arises principally from the molecular diffusion that transports momentum between layers of flow. The kinetic theory of gases allows accurate prediction of the behavior of gaseous fluidity. In general, fluidity of a gas is independent of pressure and varies inversely with temperature.

In liquids, the additional forces between molecules become important. This leads to an additional contribution to the shear stress. In general, fluidity of a liquid is independent of pressure (except at very high pressure), and tends to vary directly with temperature. The dynamic fluidities of liquids are typically several orders of magnitude lower than the dynamic fluidities of gases.

Fluidity of fluids is important in many areas of science, engineering, industry and medicine. In many cases it is desirable to increase fluidity. For example, increasing fluidity of crude oil is important to transporting offshore oil via undersea pipelines. Increasing the fluidity of gasoline or diesel can improve the fuel atomization, which can lead to more efficient combustion and less pollution. Increasing blood fluidity can improve circulation and prevent cardiovascular events.

For liquid suspensions such as crude oil, it has been shown that the fluidity can be increased through exposure to a specific field, having a specific type, power and duration. It is believed that the specific field causes particles in the crude oil to aggregate, and therefore increase the volume fraction available to the suspended particles.

For liquid mixtures such as diesel fuel, there has been some theorization that the fluidity can be increased through exposure to a field. According to these theories, an applied field effects a liquid mixture similarly to a liquid suspension, causing larger molecules in the liquid mixture to aggregate, and therefore increasing the volume fraction available to the molecules.

Generally, the effective fluidity of a liquid suspension depends on how much freedom the suspended particles have in the suspension. Lower fluidity translates into less freedom for the suspended particles, and higher fluidity translates into more freedom for the suspended particles. Theory predicts that by aggregating small particles into larger ones in a liquid suspension, the effective fluidity will increase even though the volume fraction of the particles remains the same.

According to one theory, if the applied field is strong enough to overcome Brownian motion, the particles aggregate and align in the field direction. If the field interaction is too strong, though, the particles can quickly aggregate into macroscopic chains or columns and jam the liquid flow, decreasing fluidity. If the field interaction is too weak, though, the clumps are too small to increase effective fluidity.

Some experiments found that the fluidity increases can remain even after the field is no longer present. However, over time the fluidity increase faded as the aggregated particles dissemble under Brownian motion. Experiments on crude oil found that the fluidity increase faded after about two hours at room temperature.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Figure 1:
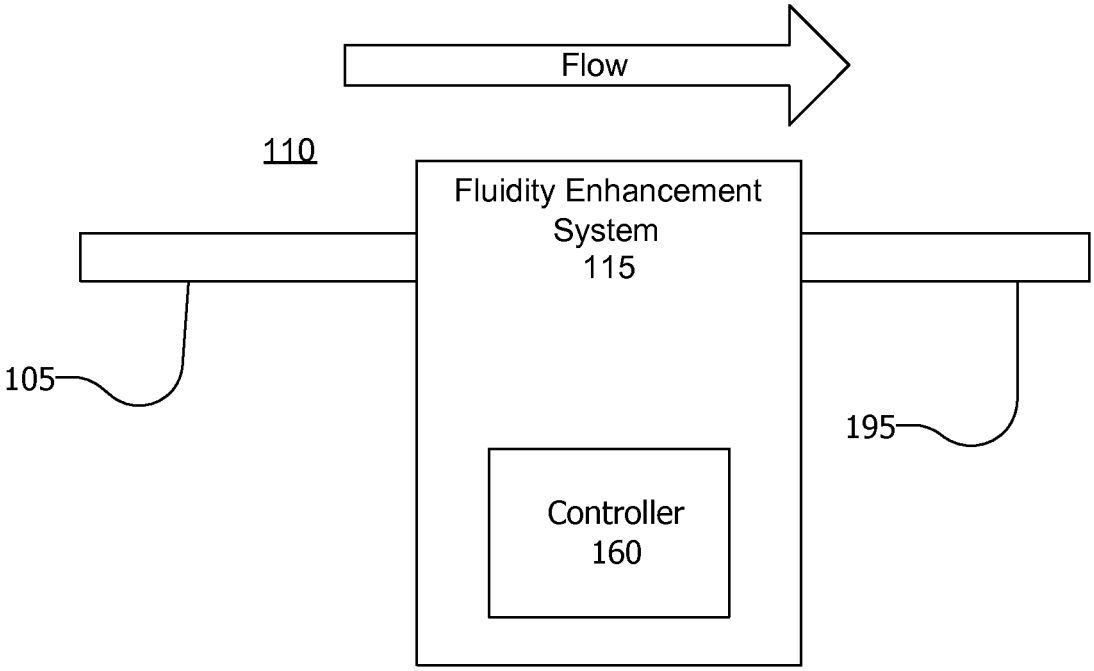
FIG. 1 is a block diagram of a section of a pipeline with a fluidity enhancement system.

Referring now to FIG. 1 there is shown a diagram of a section 110 of a pipeline including a fluidity enhancement system 115. The section 110 may be part of a long pipeline. Fluid flows through the section 110 in the direction shown, from an inlet pipe 105, through the fluidity enhancement system 115, and to an outlet pipe 195.

By fluid it is meant material which, within the fluidity enhancement system 115, is either a liquid, liquid mixture, liquid suspension or emulsion, such that the material can flow through the device at an acceptable rate. Since the state of matter depends on temperature and pressure, these factors may impact whether and when a material is a fluid. The flow rate is considered acceptable based upon the particular needs of the situation.

Fluids well-suited to fluidity enhancement as described herein include asphalt-based crude oil, diesel fuel and gasoline.

The fluidity enhancement system 115 may be sealed such that the fluid may not leave except through the outlet pipe 195, and such that the fluid and other materials may not enter except through the inlet pipe 105. There may be a tolerance for leakage in or out of the section 110, and this may apply specifically to the fluidity enhancement system 115 depending on the circumstances. Furthermore, the fluidity enhancement system 115 may include components through which the fluid and other materials are intended to enter or leave.

The fluidity enhancement system 115 treats the flowing fluid with a sequence of electric and/or magnetic fields. In sequence, the directions of the fields change. It has been found that this arrangement can provide increased fluidity over having multiple fields in the same direction.

The fluidity enhancement system 115 may include a controller 160 for controlling the fields. The fluidity enhancement system 115 may have a single housing which contains the controller 160, or the controller 160 may be entirely separate from the fluidity enhancement system 115, or some other arrangement by which the controller 160 can control the fields.

The controller 160 may include software and/or hardware for providing functionality and features described herein. The controller 160 therefore may include one or more of: logic arrays, memories, analog circuits, digital circuits, software, firmware, and processors such as microprocessors, field programmable gate arrays (FPGAs), application specific integrated circuits (ASICs), programmable logic devices (PLDs) and programmable logic arrays (PLAs). The hardware and firmware components of the controller 160 may include various specialized units, circuits, software and interfaces for providing the functionality and features described here. The processes, functionality and features may be embodied in whole or in part in software that operates on a computer and may be in the form of firmware, an application program, an applet (e.g., a Java applet), a browser plug-in, a COM object, a dynamic linked library (DLL), a script, one or more subroutines, or an operating system component or service. The hardware and software and their functions may be distributed such that some components are performed by the controller 160 and others by other devices.

Although the term pipe is used, other fluid conductors may be used, depending on the fluid and needs. For example, hoses may be used. The materials of the pipes and the fluidity enhancement system may be selected based upon the nature of the fluid to be treated, environmental conditions, and other factors.

Figure 2:
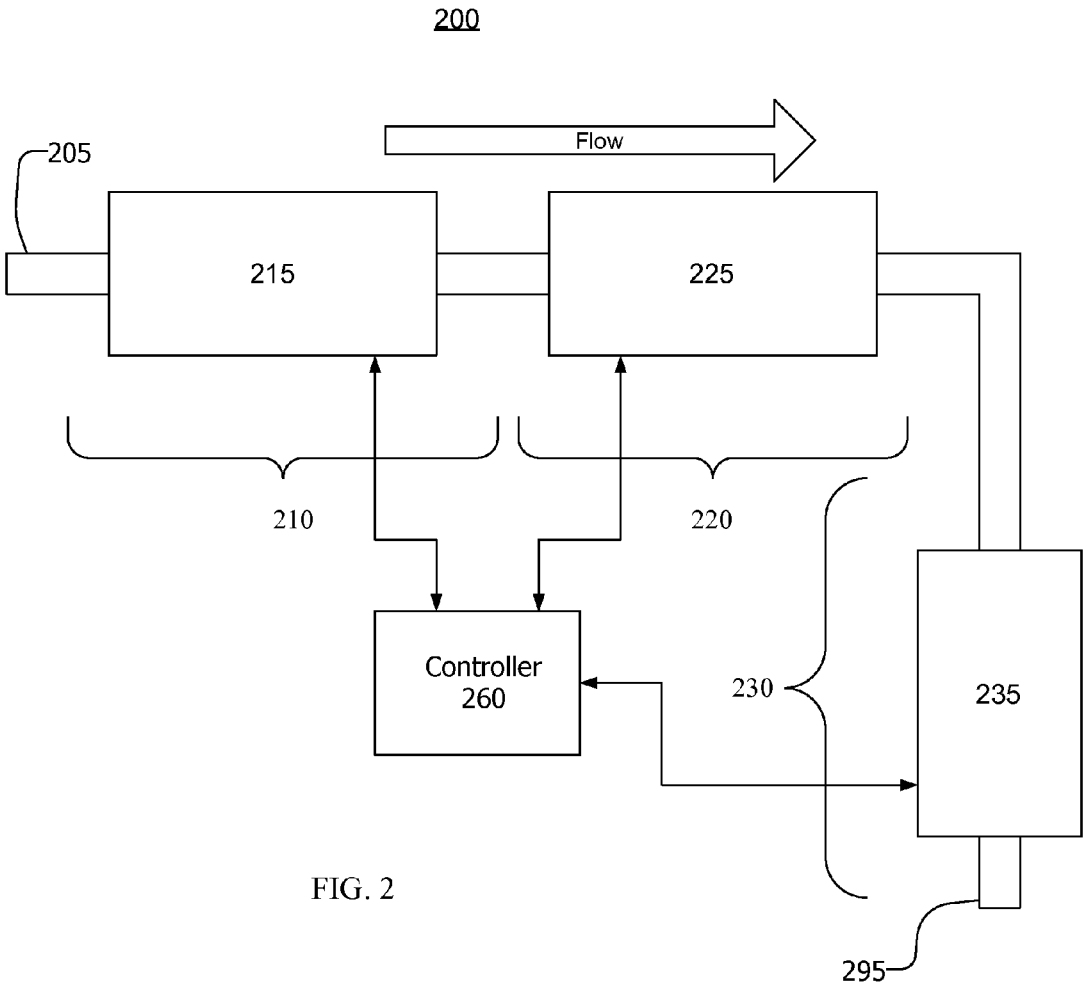
FIG. 2 is a block diagram of a section of a pipeline with plural fluidity enhancement systems.

Referring now to FIG. 2 there is shown a diagram of plural sections 210, 220, 230 of a pipeline 200 including respective fluidity enhancement systems 215, 225, 235, each of which may be the same as the fluidity enhancement system 115 of FIG. 1. The sections 210, 220, 230 may be spaced various distances apart, or one or more of the fluidity enhancement systems 215, 225, 235 may be contiguous, depending on the desired performance (e.g., flow rate) overall or at specific points of the pipeline 200. Fluid flows in the direction shown from an inlet pipe 205, through the fluidity enhancement systems 215, 225, 235, and to an outlet pipe 295. The inlet pipe 205 and outlet pipe 295 may be part of respective sections 215, 225, 235 or may be separate.

The various sections 210, 220, 230 may be directly connected or may have other components between them, with the fluid flowing from the inlet pipe 205 to the outlet pipe 295. Furthermore, there may be intermediate points within the pipeline 200 at which fluid and other materials enter or leave the pipeline.

A controller 260 may be included for controlling the fields of the fluidity enhancement systems 215, 225, 235. The controller 260 may be external to the fluidity enhancement systems 215, 225, 235, may be integrated into one, or may have distributed components. For example, there may be a master controller and slaves in one or more of the fluidity enhancement systems 215, 225, 235. Alternatively, each of the fluidity enhancement systems 215, 225, 235 may have a separate controller.

Figure 3:
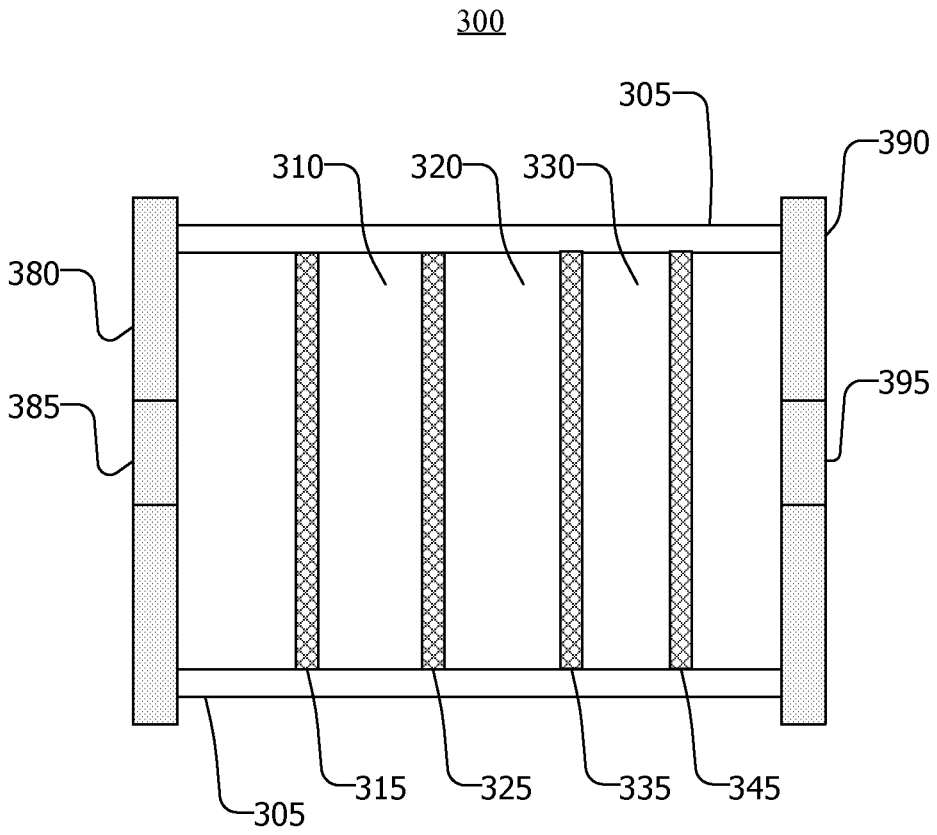
FIG. 3 is a cut-away side view of a fluidity enhancement system.

Referring now to FIG. 3 there is shown a cut-away side view of a fluidity enhancement device 300, which may be part of the fluidity enhancement system of FIG. 1. The fluidity enhancement device 300 includes a main housing 305, an inlet housing member 380, an outlet housing member 390, a first treatment chamber 310, a second treatment chamber 320 and a third treatment chamber 330. The inlet housing member 380 may include an inlet port 385 through which the fluid passes into the fluidity enhancement device 300 and then to the first treatment chamber 310. The outlet housing member 390 may include an outlet port 395 through which the fluid passes out of the fluidity enhancement device 300 from the third treatment chamber 330.

The treatment chambers 310, 320, 330 are each oriented to receive and pass the flowing fluid in turn. That is, the fluid flows through the first treatment chamber 310, then the second treatment chamber 320, then the third treatment chamber 330. In the fluidity enhancement device 300 of FIG. 3, the first treatment chamber 310, the second treatment chamber 320 and the third treatment chamber 330 are contiguous. However, treatment chambers may be spaced in a discontinuous manner.

The treatment chambers 310, 320, 330 have respective fields, and the fields each have a direction. The direction of the field in each treatment chamber 310, 320, 330 is different from the direction of the fields in each of the next adjacent chambers. Thus, the direction of the field in the second treatment chamber 320 is different from the direction of the field in the first treatment chamber 310. Likewise, the direction of the field in the third treatment chamber 330 is different from the direction of the field in the second treatment chamber 320. For example, the direction of the second field can be opposite the direction of the first field, and the direction of the third field can be the same as the direction of the first field. There can be additional fields in the sequence, with differing and possible alternating directions.

The fields may all be parallel to the direction of fluid flow, which may provide better effect than if the fields are not parallel. It is believed that in liquid suspensions the aggregated particles have a shape similar to ellipsoids with their long axis parallel to the field. Thus, if the field and the flow align, the fluidity is higher. If the ellipsoids rotate, then fluidity may decrease, but it is believed that the ellipsoids typically do not rotate.

As the fluid flows through the treatment chambers 310, 320, 330, the fluidity of the fluid increases. Any increase can be meaningful and the materiality of the increase depends on the fluid and the circumstances. For crude oil in a pipeline, it is believed that the increase is close to 20% and this is meaningful. For diesel the increase is believed to be less than 10%, which still is meaningful. There is no target or meaningful amount other than the cost-benefit from the effect. For example, if a 3% reduction of diesel fluidity yields 7% more mpg there is a real cost benefit. Thus, the type of fields and their strength, duration, and direction are selected to achieve a meaningful increase from a cost-benefit standpoint.

In the past, fluidity enhancement might be obtained through chemical means or by varying temperature or pressure. However, good results from the fluidity enhancement device 300 may be obtained with a substantially constant temperature and pressure in all treatment chambers and without the addition of additives.

The fluidity enhancement device 300 may further include electrodes 315, 325, 335, 385 which may be respectively energized to carry a charge and thereby create the fields. By using electrodes in this manner, the created fields are electric. Depending on the nature of the electric fields, magnetic fields may also be induced.

To achieve alternating, opposite field directions, the electrodes 315, 325, 335, 345 may be anodes or cathodes in alternate fashion. That is, the charge of each electrode may be opposite to that of the electrodes next adjacent, such that the charges of the electrodes in the series alternate from positive to negative in the series. This results in a series of electric fields of alternate directions within the fluidity treatment device 300. In such an arrangement, each sequential pair of electrodes, 315 and 325, 325 and 335, 335 and 345 define the treatment chambers 310, 325, 335, respectively. With additional electrodes, additional treatment chambers with respective fields may be obtained.

When energized, fields are created between paired electrodes 315 and 325, 325 and 335, 335 and 345. The fluid passes through the first field, then the second field, then the third field. With additional pairs of electrodes, there can be additional series of fields with differing directions. As many electrodes as are required to achieve the desired fluidity enhancement may be used.

The factors to consider when selecting the number of fields and their qualities include: fluid flow rate, desired fluidity enhancement, field intensity, desired exposure time, device complexity and cost, ease of maintenance and repair, and available power. For example, the applied fields may be constant or a pulse, with one or more fields being static and one or more being pulsed. These qualities may collectively or individually be changed over time.

For a magnetic field, pulse duration $\tau$ should be on the order of $$\tau = n^{-1/3}/v = \frac{\pi}{\eta_0}(\mu_p + 2\mu_f)^2 \Big/ \left[\mu_f n^{5/3} a^5 (\mu_p - \mu_f)^2 H^2\right]$$

where n is the particle number density, v is the average particle velocity, $\eta 0$ is the fluidity of the base liquid, $\mu p$ is the magnetic permeability of the particles, $\mu f$ is the magnetic permeability of the base liquid, a is the particle radius, and H is the minimum magnetic field required to firm clusters of particles.

For an electric field, magnetic permeability is replaced with the respective dielectric constant.

The pulse duration in most cases may be seconds in duration, such as one to one hundred seconds. If the pulse duration is much shorter than $\tau$, there is insufficient time for particle aggregation, and if the pulse duration is much longer than $\tau$, macroscopic chains can form and jam the flow. For example, if a field pulse is too short, the dipolar interaction does not have enough time to affect distant particles, and the particles fail to aggregate sufficiently to have a meaningful increase in fluidity.

The electrodes 315, 325, 335, 345 may be formed of a conductive material and have a form that the fluid may pass at an acceptable rate and provide a uniform field. For example, the electrode may be a mesh of copper or other conductive metal, or a solid metal electrode with holes. The electrodes 315, 325, 335, 345 may be identical or different. The electrodes 315, 325, 335, 345 may be plates or plate-like.

One or more power supplies (not shown) charge the electrodes 315, 325, 335, 345 and may be controlled by a controller as described above. The charges have respective strengths to create fields of sufficient strength to increase the fluidity of the fluid. This increase may be by at least 10% from the inlet port 385 to the outlet port 395.

The parts of the fluidity enhancement device 300 may be made from the same kinds of materials as the pipes and pipelines to which it is connected. Crude oil pipelines are typically made from steel or plastic tubes. Natural gas pipelines are typically constructed of carbon steel. These materials and the shapes of the parts may also be selected based upon their positive or negative impact on the fields.

Figure 4:
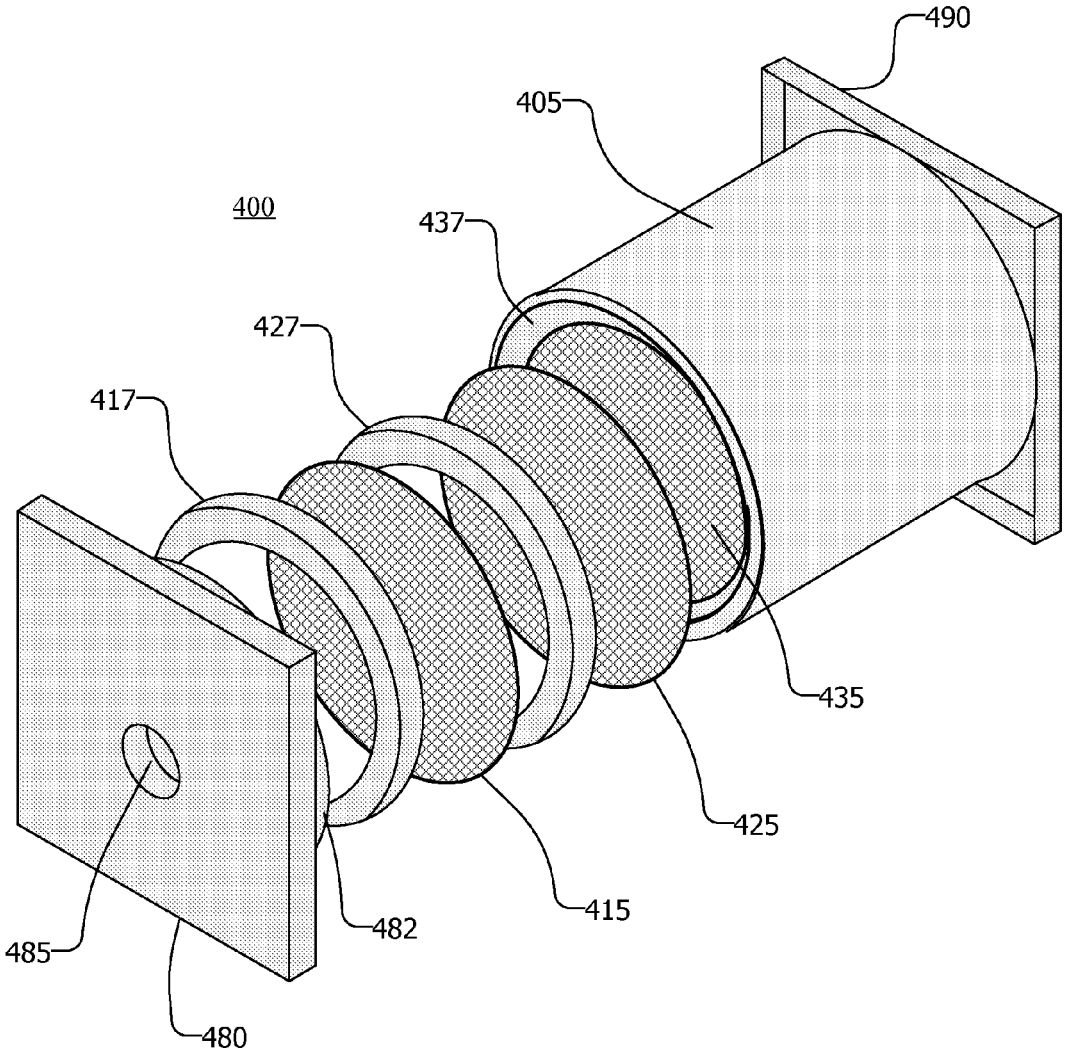
FIG. 4 is an exploded view of a fluidity enhancement device.

Referring now to FIG. 4 there is shown an exploded view of a fluidity enhancement device 400, which may be the fluidity enhancement device of FIG. 3. The relative position of various parts of the fluidity enhancement device 400 will be described based upon this view. The fluidity enhancement device 400 may be in any of various axial or radial positions, and disposed so that the fluid flows upwards, downwards or in other directions.

The fluidity enhancement device 400 has a main housing 405, an inlet housing member 480 and an outlet housing member 490, as described with respect to FIG. 3. Fluid flows into an inlet port 485 in the inlet housing member, through the main housing 405, and out an outlet port (hidden from view) in the outlet housing member 490.

The inlet housing member 480 includes a fitting 482, and the outlet housing member may include a comparable fitting (hidden from view). These fittings are adapted to fit into the main housing 405 and to snugly hold the main housing 405 to the inlet housing member 480 and the outlet housing member 490 with tolerable leakage.

The fluidity enhancement device 400 includes a number of spaced electrodes 415, 425, 435 as in FIG. 3. The electrodes 415, 425, 435 may be spaced and/or held in place by spacers 417, 427, 437 and adapted to permit a smooth flow of the fluid there through. The electrodes 415, 425, 435 are charged to create respective electric fields.

Figure 5:
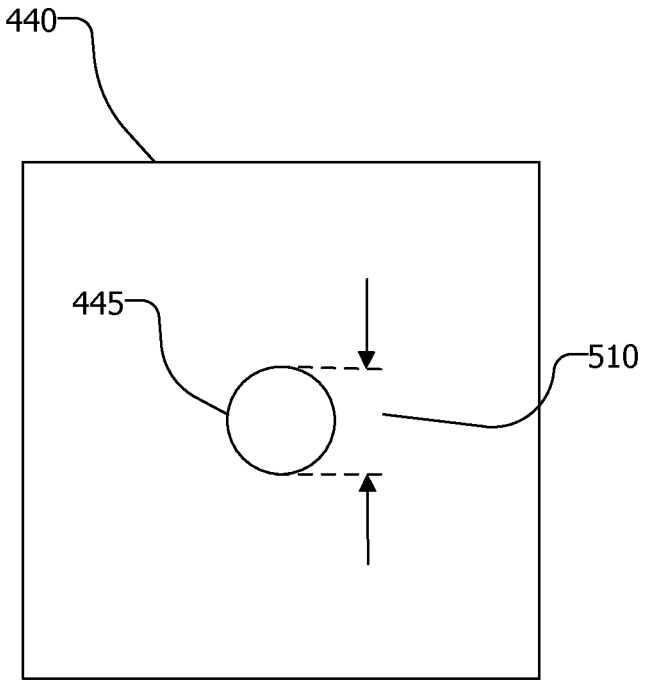
FIG. 5 is a front view of an inlet housing member of a fluidity enhancement device.

Referring now to FIG. 5 there is shown a front view of the inlet housing member 480. The outlet housing member 490 may be substantially identical to the inlet housing member 480. In this way, the fluidity enhancement device may be directionally agnostic—fluid may flow through it in either direction. With a reversed flow, it may be desirable to reverse the fields, and this may be a simple matter to control.

The inlet port 445 may be circular and have a diameter 510 selected to mate to surrounding pipe. In crude oil pipelines, trunk lines typically measure from 8 to 24 inches in diameter, and gathering lines typically measure from 2 to 8 inches in diameter. Pipelines for refined petroleum products typically vary in size from relatively small 8 to 12 inch diameter lines up to 42 inches in diameter. For natural gas, pipelines typically measure from 2 inches to 56 inches in diameter.

Figure 6:
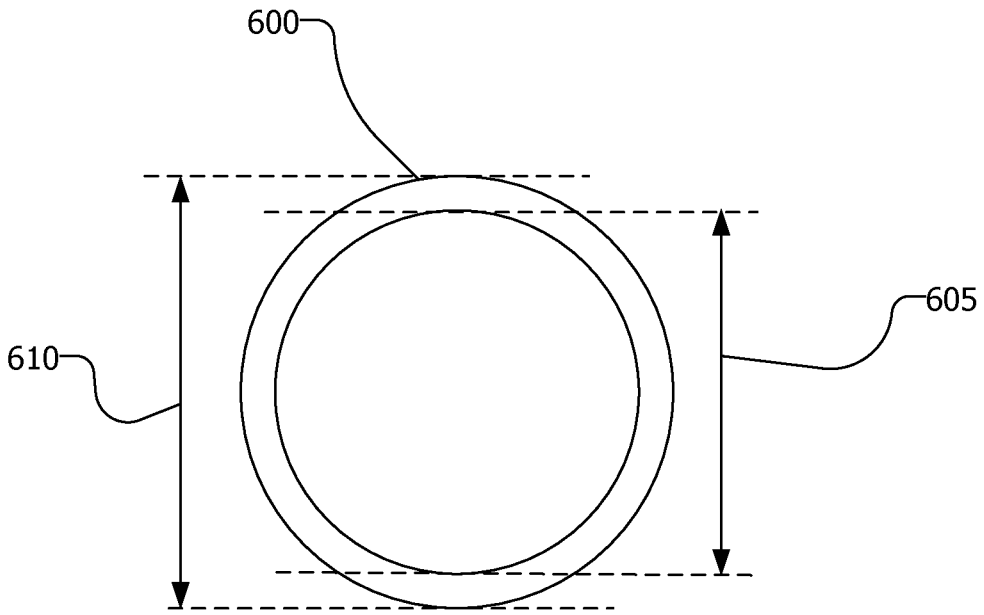
FIG. 6 is a front view of a spacer of a fluidity enhancement device.

Referring now to FIG. 6 there is shown a front view of a spacer 600, which may be representative of the spacers 417, 427, 437 of FIG. 4. The spacer 600 is generally cylindrical with a circular cross section. The spacer has an inner diameter 605 selected to accommodate the fluid of flow. According to one goal, the fluid flows through the treatment chambers at a rate which permits adequate influence of the fields on the fluid.

The spacer 600 may have a non-circular cross section, and may have a cross section with varying area in space and/or time. For example, instead of being cylindrical, the spacer may be conical. The spacer 600 may include bellows to reduce its cross-sectional area. Some or all of these features may be integrated into the main housing 405.

The spacer 600 has an outer diameter 610 or other external dimension that allows the spacer 600 to fit snugly within the main housing 405. The spacer 600 may stay in place through an interference fit, welding, adhesive, screws, rivets, or otherwise.

Figure 7:
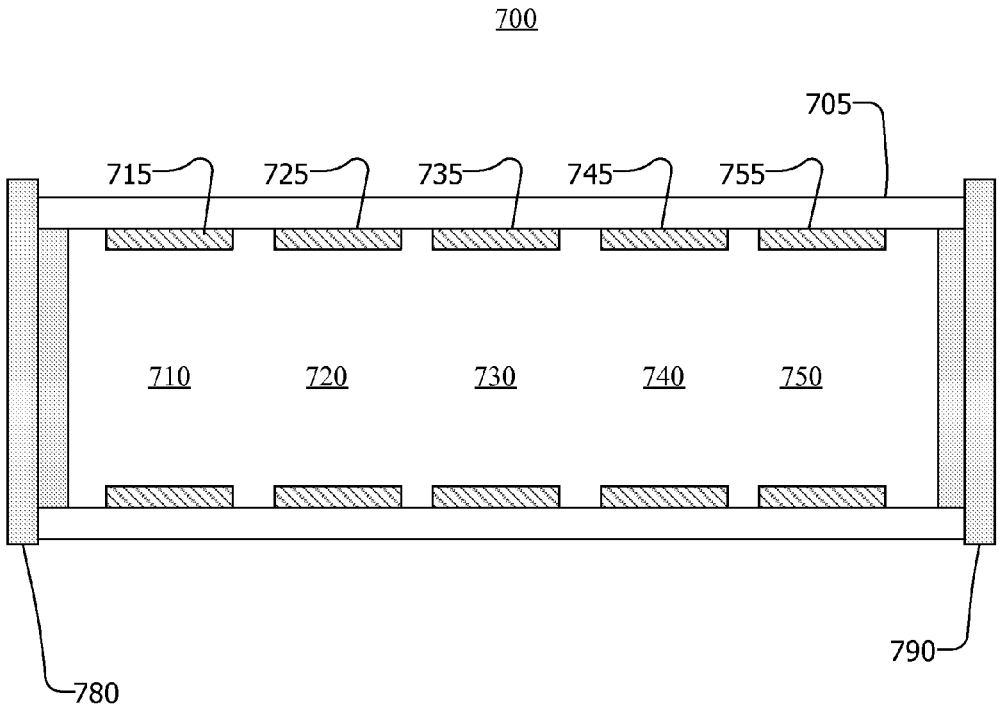
FIG. 7 is a cut-away side view of a fluidity enhancement device.

Referring now to FIG. 7 there is shown a cut-away side view of a fluidity enhancement device 700, similar to the fluidity enhancement device 300 of FIG. 3, but with five treatment chambers 710, 720 730, 740, 750 rather than three. The fluidity enhancement device 700 has coils 715, 725, 735, 745, 755 for creating magnetic fields in the respective treatment chambers 710, 720 730, 740, 750. The coils 715, 725, 735, 745, 755 may be circular and disposed against the inside wall of the main housing 705, though some or all of the coils 715, 725, 735, 745, 755 may be disposed all or partially within the main housing 705 or outside of the main housing 705. Since the fluidity enhancement device 700 has no electrodes, the treatment chambers 710, 720 730, 740, 750 are defined by the magnetic fields. The magnetic fields may induced electric fields.

The fluidity enhancement systems and devices described herein have numerous applications. An internal combustion engine with such a fluidity enhancement system may have increased fluidity of the fuel, which may cause better atomization of the fuel. Better atomization may result in more complete combustion which in turn may yield more horsepower. Additionally, emissions may be reduced. In pipelines, such as crude oil pipelines, increasing the fluidity of the fluid being piped may facilitate pumping the fluid. In oil burners, increasing the fluidity of the fuel may cause better atomization. Better atomization may result in more complete combustion which in turn will yield more BTUs. In filters, increasing the fluidity of the fluid to be filtered may allow finer filters to be used.

DESCRIPTION OF PROCESSES

Figure 8:
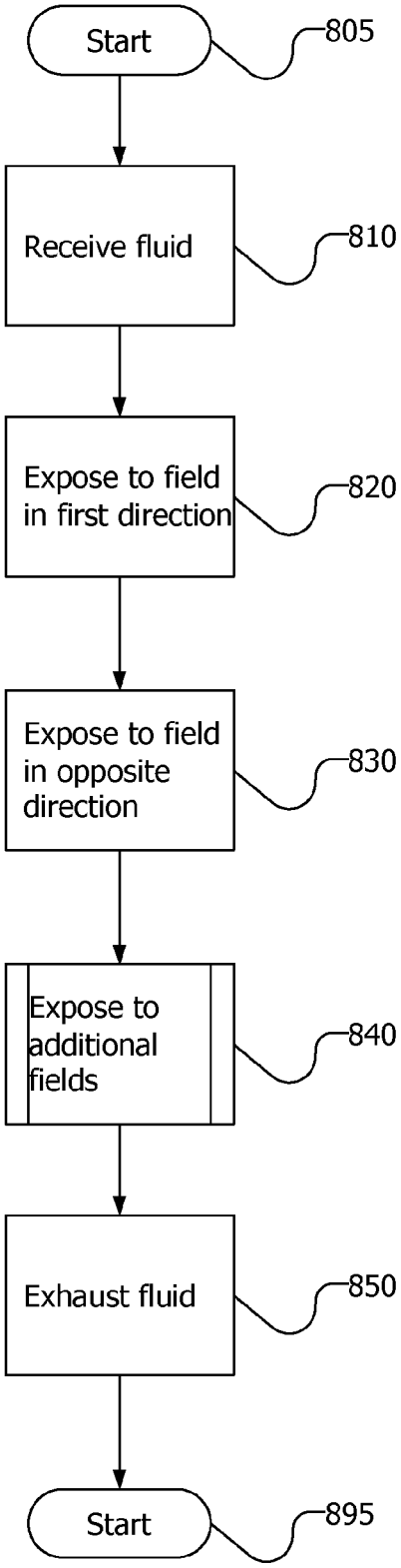
FIG. 8 is a flow chart of a process for increasing fluidity of a flowing fluid.

Referring now to FIG. 8 there is shown a flow chart of a process for increasing fluidity of a flowing fluid. In a first step 810, the flowing fluid is received. The fluid at receipt has a first fluidity. Next, the flowing fluid is exposed to a series of fields (steps 820, 830, 840). Each field in the series has a direction different from that of the field next previous. As explained above, these fields may have respectively alternate directions. Finally, the fluid is exhausted (step 850). Because of the field exposure, the fluid at exhaust (step 850) has a higher fluidity than at receipt (step 810). The fields may be controlled to be effective in combination to cause the exhaust fluidity to be at least 10% more than the receipt fluidity.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

The invention claimed is:

1. Apparatus for increasing fluidity of a fluid flowing in a first direction through a conduit, the apparatus comprising:

a housing in fluid communication with the conduit;

a first treatment chamber in the housing, the first treatment chamber defined by a first electrode and a second electrode separated by a first spacer ring, wherein the first and second electrodes are each positioned perpendicularly to the first direction, the first and second electrodes each comprising a plate with a plurality of apertures adapted to permit a smooth flow of the fluid there through, the first treatment chamber having a first electric field in the first direction created by the first electrode and the second electrode;

a second treatment chamber in the housing, the second treatment chamber defined by the second electrode and a third electrode separated by a second spacer ring, wherein the third electrode is positioned perpendicularly to the first direction, the third electrode comprising a plate with a plurality of apertures adapted to permit a smooth flow of the fluid there through, the second treatment chamber having a second electric field in a second direction which is different from the first direction, the second electric field created by the second and third electrodes; and wherein the first and second electric fields are effective in combination to cause a second fluidity of the fluid upon leaving the apparatus to be temporarily greater than a first fluidity of the fluid upon entering the apparatus.

2. The apparatus of claim 1, wherein the second direction is opposite the first direction.

3. The apparatus of claim 1 further comprising:

a third treatment chamber in the housing, the third treatment chamber defined by the third electrode and a fourth electrode separated by a third spacer ring, wherein the fourth electrode is positioned perpendicularly to the first direction, the fourth electrode comprising a plate with a plurality of apertures for allowing the flowing fluid to pass there through, the third treatment chamber having a third electric field in a third direction which is different from the second direction, the third electric field created by the third and fourth electrodes.

4. The apparatus of claim 3, wherein the third direction aligns with the first direction.

5. The apparatus of claim 1 further comprising an inlet housing member defining an inlet port through which the fluid passes into the housing and an outlet housing member defining an outlet port through which the fluid passes out of the housing.

6. The apparatus of claim 1, wherein the treatment chambers are contiguous.

7. The apparatus of claim 1, wherein the fluid is asphalt-based crude oil, diesel fuel, or gasoline.

8. The apparatus of claim 1 having a substantially constant temperature and pressure within the treatment chambers.

9. The apparatus of claim 3, wherein the first electric field overlaps the second electric field, and the second electric field overlaps the third electric field.

10. The apparatus of claim 1, wherein the first, second, and third electrodes each comprises a mesh.

11. The apparatus of claim 1, wherein the first and second electric fields have sufficient strength to cause particles suspended in the fluid to aggregate and form clusters.

12. The apparatus of claim 1, wherein the flowing fluid is exposed to the electric fields for a time sufficient to allow particles to aggregate without forming macroscopic chains.

13. Apparatus for increasing fluidity of a fluid flowing in a first direction, the apparatus comprising:

a series of charged electrodes defining a plurality of treatment chambers through which the fluid flows from an inlet port to an outlet port without significant leakage, the electrodes positioned perpendicularly to the first direction and spaced apart by spacer rings, each electrode comprising a plate with a plurality of apertures adapted to permit a smooth flow of the fluid there through;

wherein the charge of each electrode is opposite to that of the electrodes next adjacent, whereby the charges of the electrodes in the series alternate from positive to negative in the series;

wherein the charges create respective electric fields in alternate directions; and wherein the charges have respective strengths to create electric fields of sufficient strength to increase the fluidity of the fluid from the inlet port to the outlet port.

14. The apparatus of claim 13, wherein the fields are parallel to the first direction.

15. The apparatus of claim 13, wherein the fluid is asphalt-based crude oil, diesel fuel, or gasoline.

16. The apparatus of claim 13 having a substantially constant temperature and pressure within the treatment chambers.

17. The apparatus of claim 13, wherein at least some of the electric fields overlap.

18. The apparatus of claim 13, wherein each of the electrodes comprises a mesh.

19. A process for increasing fluidity of a flowing fluid comprising:

receiving the flowing fluid in a first direction, the fluid at receipt having a first fluidity;

exposing the flowing fluid to a series of electric fields by causing the flowing fluid to flow through a plurality of apertures in each of a series of electrodes, each electrode positioned perpendicularly to the first direction, each electric field in the series created by two electrodes of the series of electrodes separated by a spacer ring, each electric field having a direction different from that of the electric field next previous, wherein the direction of each electric field is parallel to the first direction;

exhausting the fluid, the fluid at exhaust having a second fluidity; and wherein the electric fields are effective in combination to cause the second fluidity to be more than the first fluidity.

20. The process of claim 19 further comprising:

exposing the flowing fluid to a series of additional electric fields after exhausting the fluid, each additional electric field in the series created by two additional electrodes separated by an additional spacer ring, each additional electric field having a direction different from the additional electric field next previous, wherein the direction of each additional electric field is parallel to the first direction.

21. Apparatus for increasing fluidity of a fluid flowing in a first direction through a conduit, the apparatus comprising:

a housing in fluid communication with the conduit;

a first treatment chamber in the housing, the first treatment chamber adapted to permit the flowing fluid to pass there through, the first treatment chamber defined by a first magnetic field in the first direction, the first magnetic field created by a first coil;

a second treatment chamber in the housing, the second treatment chamber adapted to permit the flowing fluid to pass there through after passing through the first treatment chamber, the second treatment chamber defined by a second magnetic field in a second direction which is different from the first direction, the second magnetic field created by a second coil;

wherein the fluid has a first fluidity prior to entering the apparatus and a second fluidity after leaving the apparatus; and wherein the first and second magnetic fields are effective in combination to cause the second fluidity to be more than the first fluidity.

22. The apparatus of claim 21, wherein the first and second coils are each disposed against an inside wall of the housing, the first coil and second coils each adapted to permit a smooth flow of the fluid there through.

23. The apparatus of claim 21, wherein the first and second coils are each at least partially disposed outside of the housing.

* * * * *